US008109385B2

(12) United States Patent
Wiggins et al.

(10) Patent No.: US 8,109,385 B2
(45) Date of Patent: Feb. 7, 2012

(54) NUTRITIVE SUBSTANCE DELIVERY CONTAINER

(75) Inventors: Robin P. Wiggins, Newburgh, IN (US); Niphon Withitanun, Bangkok (TH); Rick Grelewicz, Columbia, MD (US); Nagendra Rangavajla, Dublin, OH (US); Joshua C. Anthony, Evansville, IN (US); Patrick E. McCallister, Newburgh, IN (US)

(73) Assignee: Mead Johnson Nutrition Company, Evansville, IN (US)

( * ) Notice: Subject to any disclaimer, the term of this patent is extended or adjusted under 35 U.S.C. 154(b) by 297 days.

(21) Appl. No.: 12/574,271

(22) Filed: Oct. 6, 2009

(65) Prior Publication Data

US 2010/0089790 A1 Apr. 15, 2010

Related U.S. Application Data

(60) Provisional application No. 61/105,054, filed on Oct. 14, 2008.

(51) Int. Cl.
*B65D 25/08* (2006.01)

(52) U.S. Cl. ..... 206/221; 206/219

(58) Field of Classification Search ..... 206/219–222, 206/528, 531, 532, 568; 215/DIG. 8; 426/115, 426/120

See application file for complete search history.

(56) References Cited

U.S. PATENT DOCUMENTS

| | | | | |
|---|---|---|---|---|
| 5,076,493 | A * | 12/1991 | Anderson | 229/125.15 |
| 5,529,179 | A * | 6/1996 | Hanson | 206/219 |
| 5,707,353 | A | 1/1998 | Mazer et al. | |
| 5,921,955 | A | 7/1999 | Mazer et al. | |
| 6,098,795 | A | 8/2000 | Mollstam et al. | |
| 6,105,760 | A * | 8/2000 | Mollstam et al. | 206/222 |
| 6,564,934 | B1 * | 5/2003 | Dischler | 206/219 |
| 6,769,539 | B2 * | 8/2004 | Stern et al. | 206/222 |
| 2001/0004054 | A1 | 6/2001 | Mollstam et al. | |
| 2002/0040856 | A1 | 4/2002 | Mollstam et al. | |
| 2004/0011677 | A1 * | 1/2004 | Arakawa et al. | 206/216 |
| 2009/0084787 | A1 * | 4/2009 | Ikenoya | 220/255.1 |

FOREIGN PATENT DOCUMENTS

| | | |
|---|---|---|
| EP | 1529742 | 5/2005 |
| EP | 1440895 | 7/2007 |
| EP | 1902967 | 3/2008 |
| WO | 2004113196 | 12/2004 |

* cited by examiner

*Primary Examiner* — Luan K Bui
(74) *Attorney, Agent, or Firm* — Waddey & Patterson, P.C.; James R. Cartiglia

(57) ABSTRACT

The present invention is directed to a container for delivering a nutritive substance. In an embodiment, the present invention comprises a container that protects a nutritive substance from contact with the contents of the container and from contact with the atmosphere until the consumer is ready to use or consume the product. When desired, a seal on the container is altered such that the nutritive substance can come into contact with the container contents, delivering the nutritive substance thereto.

9 Claims, 11 Drawing Sheets

NUTRITIVE SUBSTANCE DELIVERY CONTAINER

This application claims benefit of Provisional Application No. 61/105,054filed on Oct. 14, 2008.

BACKGROUND OF THE INVENTION

Field of the Invention

The present invention relates generally to the field of container constructions.

SUMMARY OF THE INVENTION

Briefly, therefore, the present invention is directed in an embodiment to a container for delivering a nutritive substance comprising a container body having a base, at least one sidewall, and a top wall, wherein an aperture is formed in the top wall. The container also comprises an outer releasable seal releasably bonded to the exterior of the top wall, surrounding the aperture. The container has an inner sealing layer permanently bonded to the interior of the top wall, surrounding the aperture, wherein the inner sealing layer and the outer releasable seal are permanently bonded to one another within the aperture. In addition the container comprises a nutritive substance disposed between the inner sealing layer and the outer releasable seal such that removal of the outer releasable seal and inner sealing layer exposes the nutritive substance to the contents of the container.

The invention is also directed, in an embodiment, to a container for delivering a nutritive substance comprising a container body having a base and at least one sidewall, wherein an aperture is formed near the top edge of one sidewall. An outer pierceable seal is permanently bonded to the outside of the sidewall, covering the aperture. In addition, an inner pierceable seal is permanently bonded to the inside of the sidewall, covering the aperture. In this embodiment, the outer pierceable seal and inner pierceable seal form a pocket that is located within the aperture and a nutritive substance is located within the pocket.

In yet another embodiment, the invention is directed to a container for delivering a nutritive substance comprising a container body having a base and at least one sidewall, wherein a weakened region is formed near the top edge of one sidewall. An inner pierceable seal is permanently bonded to the inside of the sidewall, surrounding the weakened region, and the sidewall and inner pierceable seal form a pocket surrounding the weakened region. A nutritive substance is located within the pocket.

In a still further embodiment, the invention is directed to a container for delivering a nutritive substance comprising a container body having a base, at least one sidewall, and a top wall, wherein an aperture is formed in the top wall. A blister pack comprising a top layer and a bottom layer is permanently sealable to the container top wall over the aperture. The blister pack layers are formed to create a cavity therebetween and a nutritive substance is disposed within the blister pack cavity.

In yet another embodiment, the invention is directed to a container for delivering a nutritive substance comprising a container body having a base, at least one sidewall, and a top wall, wherein perforation lines are formed in the top wall such that the wall may be ruptured along the perforation lines under pressure. A blister pack comprising a top layer and a bottom layer is permanently sealable to the container top wall over the perforation lines. The blister pack layers are formed to create a cavity therebetween and a nutritive substance is disposed within the blister pack cavity.

BRIEF DESCRIPTION OF THE DRAWINGS

A full and enabling disclosure of the present invention, including the best mode thereof directed to one of ordinary skill in the art, is set forth in the specification, which refers to the appended figures, in which.

DETAILED DESCRIPTION OF THE PREFERRED EMBODIMENTS

Figure 1:
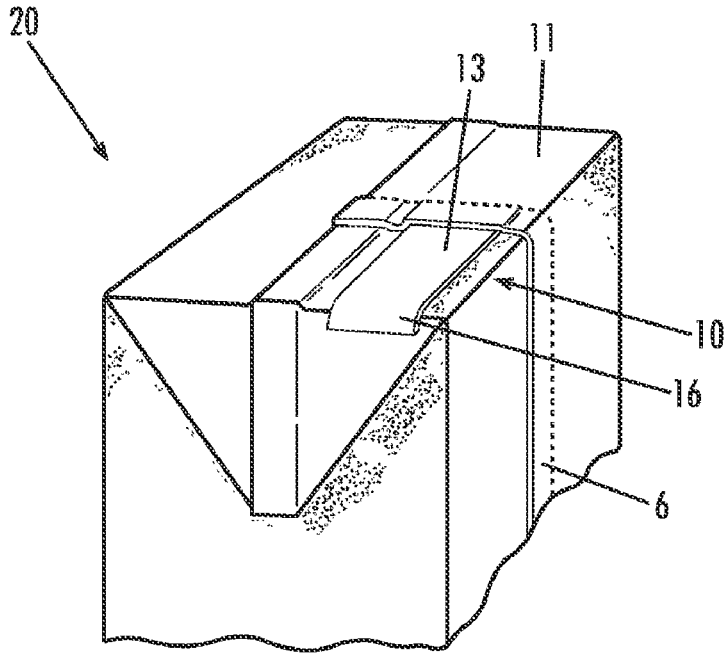
FIG. 1 is a partial perspective view of a container in accordance with one embodiment of the present invention.

Reference now will be made in detail to the embodiments of the invention, one or more examples of which are set forth below. Each example is provided by way of explanation of the invention, not a limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment.

Thus, it is intended that the present invention covers such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention. A repeat use of reference characters in the present specification and drawings represents the same or analogous features or elements of the invention.

As set forth above, the present invention relates generally to the field of container constructions. References related to container constructions may include U.S. Pat. Nos. 5,707,353 and 5,921,955 to Mazer, et al. and U.S. Pat. No. 6,098,795 to Mollstam, et al.

The technical problem to be solved by the present invention is to provide novel containers that are useful in delivering a nutritive substance to the contents of a container just before consumption of the contents. Thus, in an embodiment, the present invention is directed to containers that protect a nutritive substance from contact with the contents of the container and from contact with the atmosphere until the consumer is ready to use or consume the product. When desired, a seal on the container is altered such that the nutritive substance can come into contact with the container contents, delivering the nutritive substance thereto.

In an embodiment, the container is a rigid carrier of paper, cardboard, or other fibrous material. The container may have one or both sides coated with a plastic material, such as polyethylene, which provides the container with the required liquid tightness and barrier properties. The container may additionally have one or more metal foil layers, such as aluminum foil, between the paper layer and the plastic layer. In some embodiments, the paper or cardboard container is coated with wax. In a particular embodiment, the container is packaged under aseptic conditions such that the contents of the container maintain their sterility in the closed container over a sustained period of time.

Referring now to the drawings, FIG. 1 illustrates an embodiment of the container 20 in a parallelepipedic configuration. In another embodiment, the container 20 may have a gable-top configuration. The container 20 may be produced in any shape known in the art or yet to be developed. For example, the container may be square, rectangular, or round. The container may have a base (not shown), at least one sidewall 6, and a top wall 11.

Figure 2:
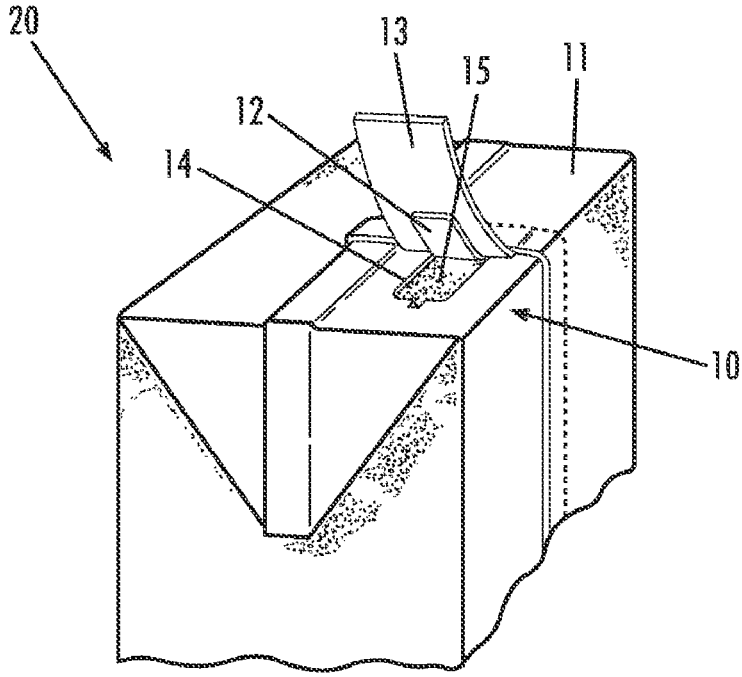
FIG. 2 is a partial perspective view of a container in accordance with an embodiment of the present invention in which the outer releasable seal is pulled back from the container.

FIGS. 1 and 2 further illustrate the container 20 having an aperture 15 in the top wall 11 of the container 20. In an embodiment, the aperture 15 may be located near a corner edge of the top wall 11. However, this aperture 15 location is not required. The aperture 15 may be located anywhere in the top wall 11 of the container 20. Alternatively, the aperture 15 may be located in a sidewall of the container. Similarly, while the aperture 15 is shown as being rectangular in FIG. 2, it could be circular, triangular, ovular, oblong, or any other shape that is known in the art or yet to be developed. The aperture may be punched into the paper or cardboard material prior to construction or filling of the container.

A closure 10 is shown in the drawings. An outer releasable seal 13 is shown as covering the aperture 15. The outer releasable seal 13 may be disposed such that it covers both the aperture 15 and a region surrounding the aperture 15. The outer releasable seal 13 may be releasably sealed to the top wall 11 of the container 20 surrounding the aperture 15. One skilled in the art should be familiar with such releasably attached seals. Specifically, adhesive or heat may be used to attach outer releasable seal 13 to top wall 11 to form an airtight seal. The outer releasable seal 13 may be formed of polyvinyl chloride, polystyrene, a laminate foil, or other suitable material.

The outer releasable seal 13 may have a pull-tab 16 located along one edge of the seal, which extends outwardly or upwardly from the outer releasable seal 13. The pull-tab 16 enables a user to pull upwards and/or backwards on the outer releasable seal 13 to reveal the aperture 15. In another embodiment, the pull-tab 16 may be attached across the center of outer releasable seal 13, configured such that pulling up and away from the container 20 reveals aperture 15. Pull-tab 16 may be formed from the same material as outer releasable seal 13 or may be formed of, or coated with, a different material to increase gripability of the tab. The pull-tab 16 may be bonded to or integrally formed with outer releasable seal 13.

Figure 3:
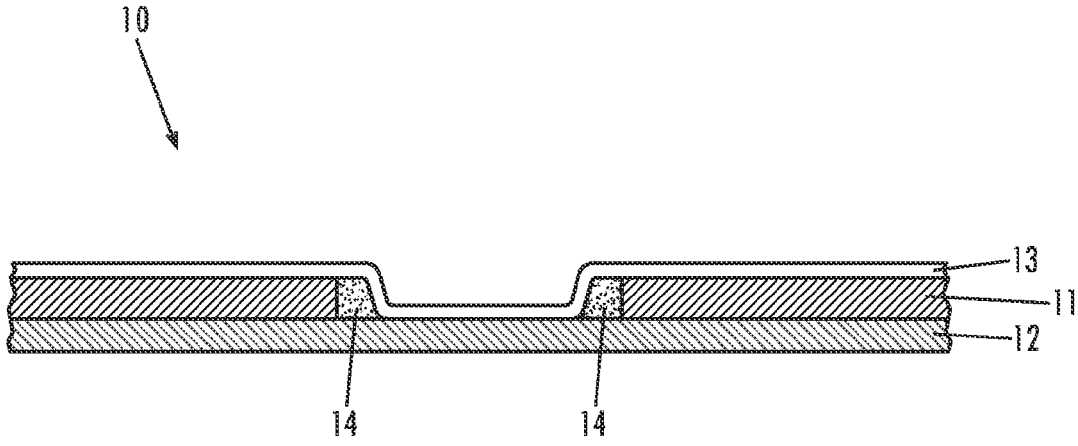
FIG. 3. is a partial cut-away view of the container in accordance with a particular embodiment.
Figure 4:
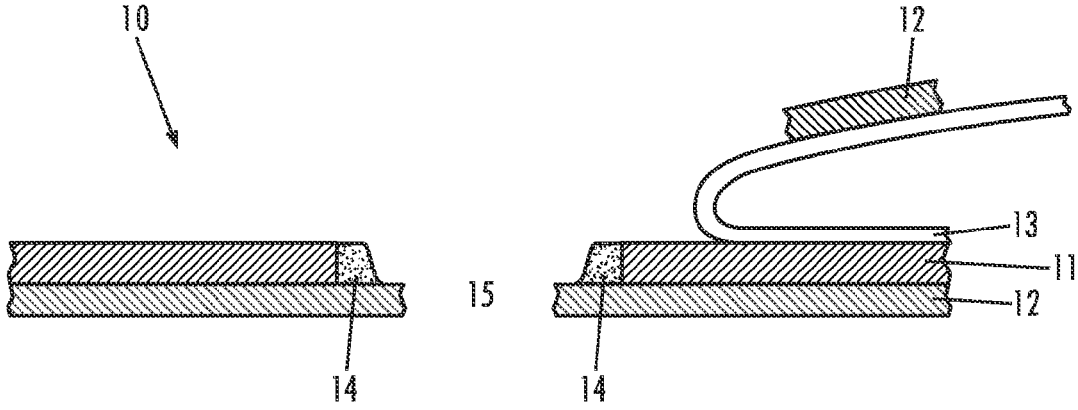
FIG. 4 is a partial cut-away view of the container in which the outer releasable seal has been pulled away from the container.
Figure 5:
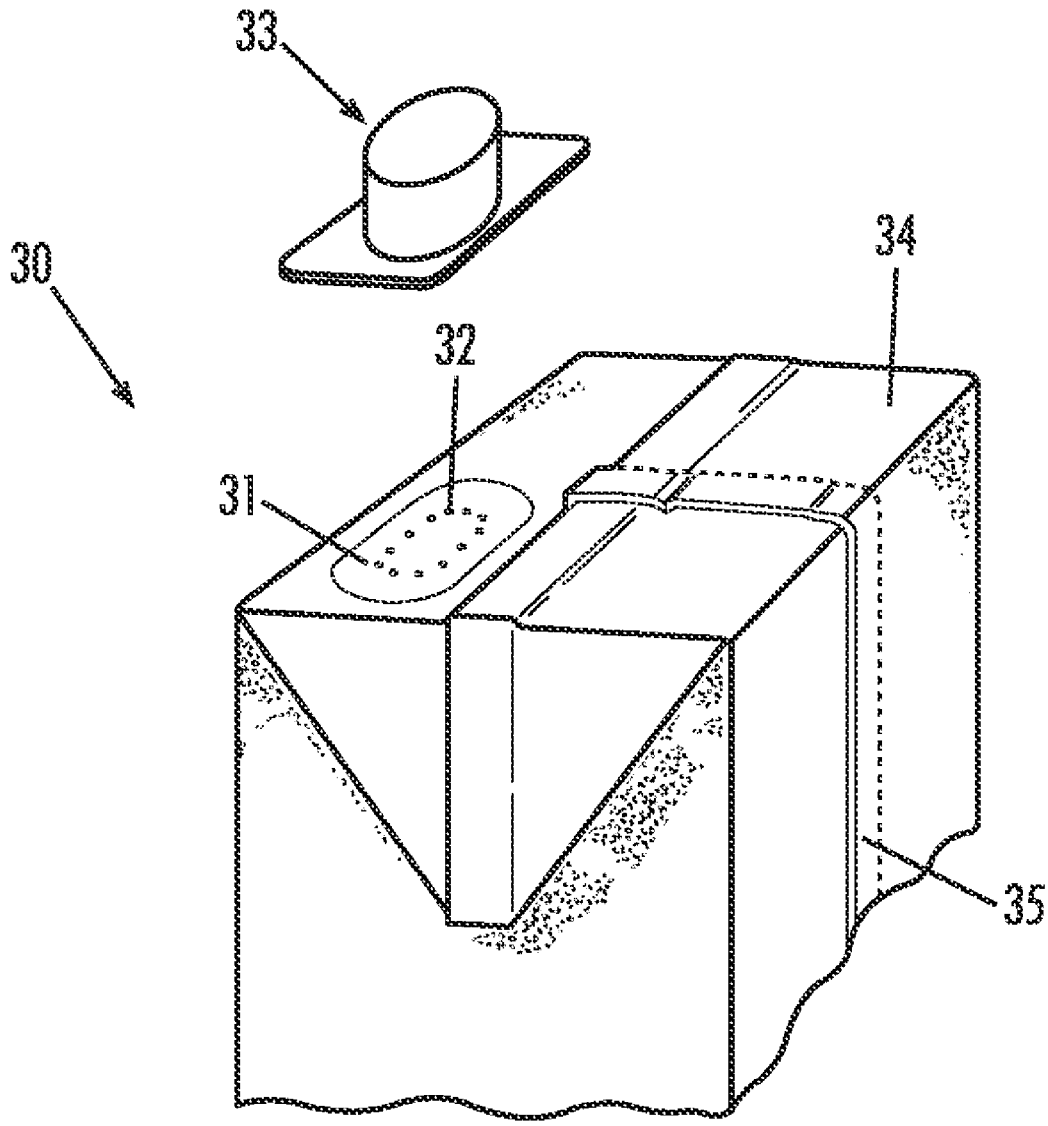
FIG. 5 is a partial perspective view of a container in accordance with an embodiment of the present invention.
Figure 6:
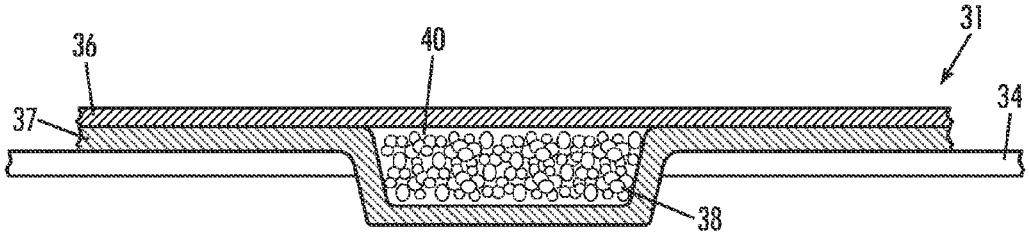
FIG. 6 is a partial cut-away view of the container in accordance with a particular embodiment.
Figure 7:
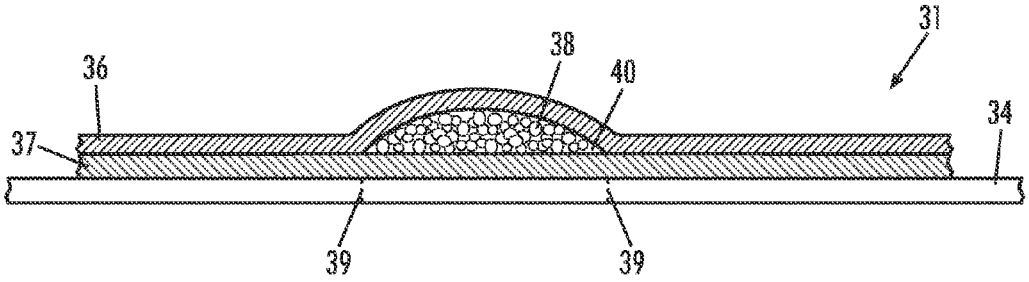
FIG. 7 is a partial cut-away view of the container in accordance with another embodiment.
Figure 8:
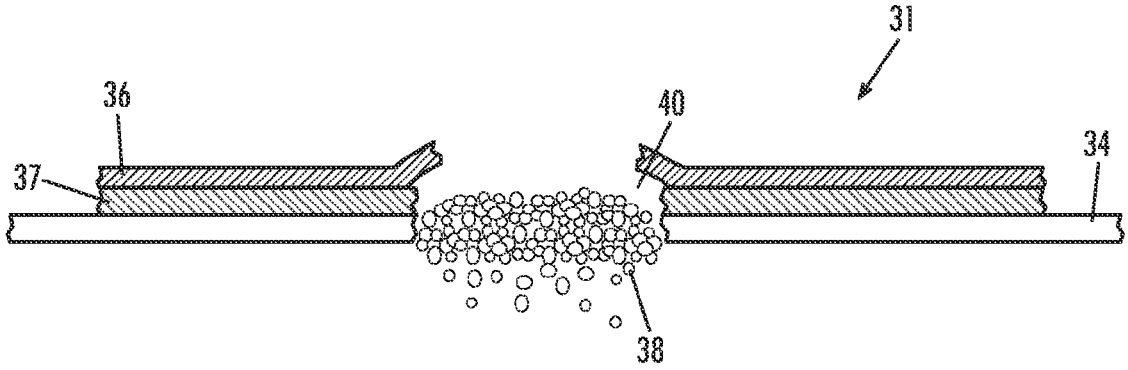
FIG. 8 is a partial cut-away view of a container embodiment in which the blister pack has been broken.

As shown in FIGS. 3-4, aperture 15 is sealed off from the container contents by an inner sealing layer 12. The inner sealing layer may be a part of an unbroken interior layer of the packaging material or may be a specially applied strip which is sealed around the aperture 15 against the inside of the container 20. In an embodiment, the inner sealing layer 12 is permanently bonded to the interior of the container surrounding the aperture 15. In another embodiment of the invention, the inner sealing layer 12 is permanently bonded to the outer releasable seal 13 in the region within the aperture 15. Such permanent bond may be achieved through pressure, heat, or other means known in the art. The inner sealing layer 12 may be formed of polyvinyl chloride, polystyrene, a laminate foil, or other suitable material.

In an embodiment, the inner sealing layer 12 may have perforation or weakening lines present along the edge of the aperture 15. This arrangement eases the removal of the portion of inner sealing layer 12 that is within the aperture 15 when the outer releasable seal 13 is removed from the container 20.

In an embodiment shown in FIGS. 2-4, a nutritive substance 14 may be present in the space between the outer releasable seal 13, the inner sealing layer 12, and the container top wall 11. The nutritive substance 14 may surround the circumference of the aperture or may be present near one side or edge of the aperture. The nutritive substance 14 may be bonded to the upper side of the inner sealing layer 12 or the portion of the container top wall 11 which is located between the outer releasable seal 13 and the inner sealing layer 12. In this configuration, the nutritive substance 14 is protected from the container contents and the atmosphere until the outer releasable seal 13 is altered or removed.

When the consumer is ready to consume or use the contents of the container, pull-tab 16 may be gripped and pulled away from container 20, causing the bond between the outer releasable seal 13 and the container top wall 11 to fail. The outer releasable seal 13 may be wholly removed from container 20 or, as shown in FIGS. 2 and 4, may be partially pulled backward enough to reveal aperture 15. If present, the perforation or weakening lines on the inner sealing layer 12 may be subjected to stress and may break. The bond between outer releasable seal 13 and inner sealing layer 12, however, is maintained and the portion of inner sealing layer 12 within the aperture 15 is removed from the container. The nutritive substance 14 remains attached to the portion of inner sealing layer 12 which remains attached to top wall 11 or the portion of top wall 11 which surrounds the aperture 15. The container contents and nutritive substance 14 are then exposed to the atmosphere because the aperture 15 is exposed. Each time the consumer inverts the container 20, the contents of the container 20 flow from the container through aperture 15 and into contact with the nutritive substance 14, providing a gradual release of the nutritive substance 14 prior to or during consumption of the product.

In a separate embodiment, the nutritive substance 14 may fall into the container contents upon removal of the portion of inner sealing layer 12 within the aperture 15. In this embodiment, the nutritive substance immediately contacts the product within the container.

In some embodiments, the container may be used to pour the container contents out for use in a recipe or into another container for mixing with other ingredients or components. In a different embodiment, the container may be used to pour out the contents into another container for consumption. In yet another embodiment, a consumer may drink directly from the container. In such an embodiment, the consumer may place the aperture 15 directly to his or her mouth, invert the container, and drink therefrom. In other embodiments, a consumer may insert a straw through the aperture 15 and consume the contents through the straw. In further embodiments, the container may be used for cooking of products directly in the container. For example, the container could be vented and used to cook a frozen food.

In some embodiments, the container 20 may be resealed after opening. Any resealing mechanism known in the art could be used in this embodiment. For example, the outer releasable seal 13 could be manufactured such that it can be used for re-closing the aperture 15 after use of the product. As another example, a cap or lid may be used to reseal the container.

In another embodiment shown in FIGS. 5-8, the container 30 may again have a parallelepipedic configuration. In another embodiment, the container 30 may have a gable-top configuration. The container 30 may be produced in any shape known in the art or yet to be developed. For example, the container may be square, rectangular, or round. The container may have a base (not shown), at least one sidewall 35, and a top wall 34.

The container 30 may have an aperture (not shown) in the top wall 34 of the container 30. The aperture may be located anywhere in the top wall 34 of the container 30. Alternatively, the aperture may be located in a sidewall of the container. Similarly, the aperture could be circular, triangular, ovular, oblong, or any other shape that is known in the art or yet to be developed. The aperture may be punched into the paper or cardboard material prior to construction or filling of the container.

In another embodiment, the container 30 may not have an aperture, but may have perforation lines 39 (shown in FIG. 7) formed in the top wall 34 of the container. The perforation lines 39 may be circular, triangular, ovular, oblong, or any other shape that is known in the art or yet to be developed.

In the embodiment shown in FIGS. 5-8, a blister pack 31 may be applied to the container over the aperture or perforation lines 39. The blister pack 31 may comprise a bottom layer 37 and a top layer 36. In one embodiment (FIG. 6), the bottom layer 37 of the blister pack 31 is deformed and encases a cavity 40 formed between bottom layer 37 and top layer 36. The top wall 34 of the container 30 has an aperture formed therein in this embodiment. The bottom layer 37 of the blister pack 31 fits within the aperture formed in top wall 34. The blister pack 31 may be permanently sealable to the top wall of the container 30, thereby preventing contact between the container contents and the atmosphere upon sealing.

In this embodiment, both of bottom layer 37 and top layer 36 are rupturable. Upon rupture of the bottom layer 37 and top layer 36, a nutritive substance 38 stored within the cavity is released into the container 30.

In another embodiment (FIG. 7), the top layer 36 of the blister pack 31 comprises a deformable raised portion which encases a cavity 40 formed between bottom layer 37 and top layer 36. The top wall 34 of the container 30 may or may not have an aperture formed therein. The top wall 34 may contain perforation lines 39 formed therein.

In this embodiment, both of bottom layer 37 and top layer 36 are rupturable. If the container top wall 34 has perforation lines formed therein, the area within such perforation lines is also ruptured upon rupture of the bottom layer 37 and top layer 36. The nutritive substance 38 stored within the cavity is then released into the container 30.

The layers of the blister pack 31 may be formed of polyvinyl chloride, polystyrene, a laminate foil, or other suitable material. The blister pack 31 may be ruptured by insertion of a straw therethrough, manual pressure exerted by a users finger, use of the container cap to rupture, or any other means known in the art or yet to be developed.

Figure 9:
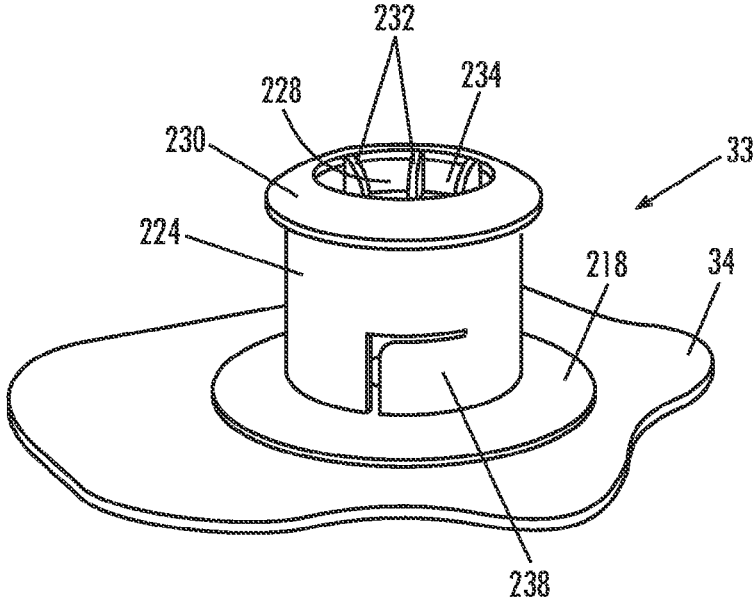
FIG. 9 is a partial perspective view of a container top in accordance with one embodiment of the present invention.
Figure 10:
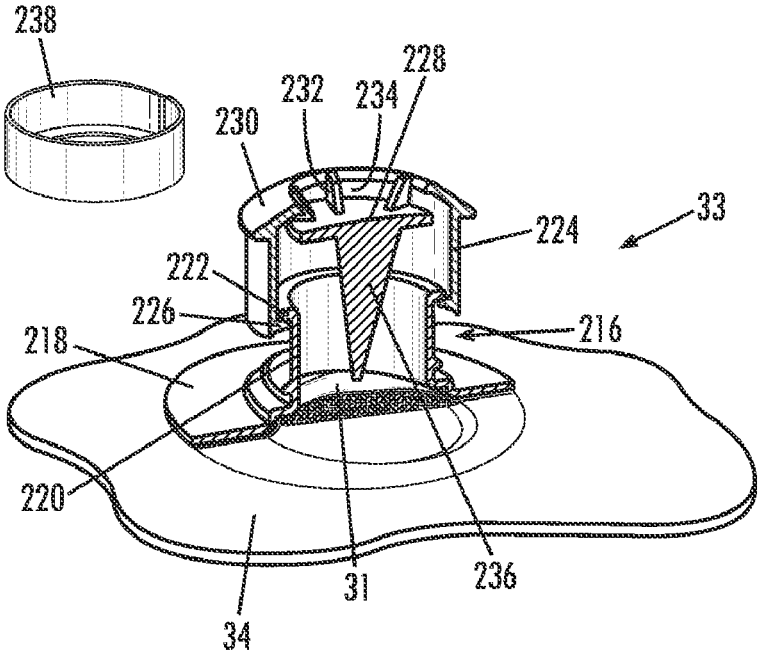
FIG. 10 is a partial perspective cut-away view of the container top illustrated in FIG. 9.
Figure 11:
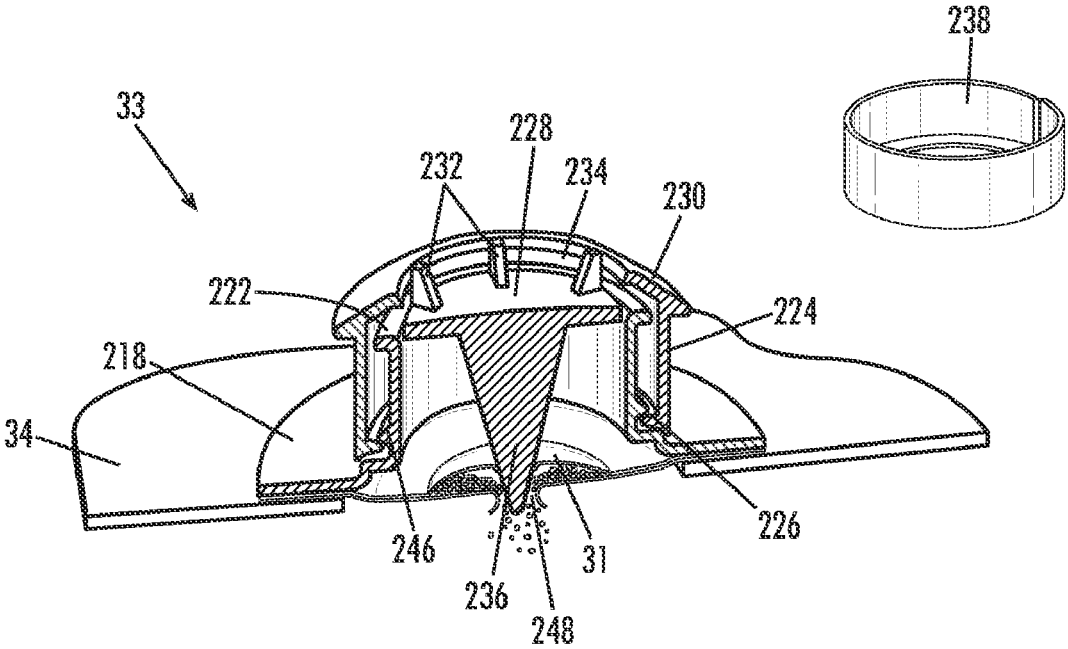
FIG. 11 is a partial perspective cut-away view of the container top illustrated in FIG. 9.

In a particular embodiment (FIG. 5), a closure 33 is sealed over the blister pack 31. The closure 33 may have means therein to rupture the blister pack 31. For example, as shown in FIGS. 9-11, the closure 33 may comprise a body 216 with a base 218 formed at one end of a vertical wall 220 and a flange 222 formed at the other end. An annular cap 224 may be received by vertical wall 220 and define an inwardly pointing flange 226 that cooperates with vertical wall flange 222. Annular cap 224 may include a top surface 228 that connects to a shoulder 230 by a plurality of ribs 232. A plurality of holes 234 may be defined between ribs 232. Annular cap top surface 228 may define a downward pointing cutting portion, or spike 236, which may be formed by a flat body or may include multiple ribs or spikes positioned transverse to one another. A tear band 238 (FIG. 9) may connect to a bottom edge of annular cap 224 to maintain annular cap 224 in an extended position relative to body 216. In other words, tear band 238 may prevent annular cap 224 from being pressed downward with respect to vertical wall 220.

With reference to FIGS. 10-11, the blister pack 31 may be bonded to the top wall 34 of container 30. Referring to FIG. 11, in use, a consumer may remove tear band 238 (FIG. 10) and press annular cap 224 downward with respect to body vertical wall 220. As annular cap 224 moves downward, spike 236 begins to pierce the blister pack 31. The consumer can continue to press annular cap 224 downward until inwardly pointing flange 226 bottoms out against base 218, which will pierce the largest hole 248 in blister pack 31, thereby exposing the nutritive substance 38 to the contents of the container. In this arrangement, closure 33 is in its closed first position where annular cap inwardly pointed flange 226 engages a second outward extending flange 246 on body vertical wall 220, thereby retaining the cap in the closed position. While closed, the consumer may shake the contents of the container causing the contents of the container to contact the nutritive substance.

If the user pulls annular cap 224 upward, annular cap inwardly pointing flange 226 moves over flange 246 and is prevented further upward movement when it contacts vertical wall outwardly pointing flange 222. In this position, each time the consumer inverts the container, the contents of the container flow from the container 30 through hole 248 into contact with the nutritive substance 38, which provides a gradual release of the nutritive substance during consumption of the product. It should be understood that a tear band is not required in this embodiment. Any device which prevents spike 236 from contacting blister pack 31 until just before consumption of the product may be utilized in this embodiment.

Figure 12:
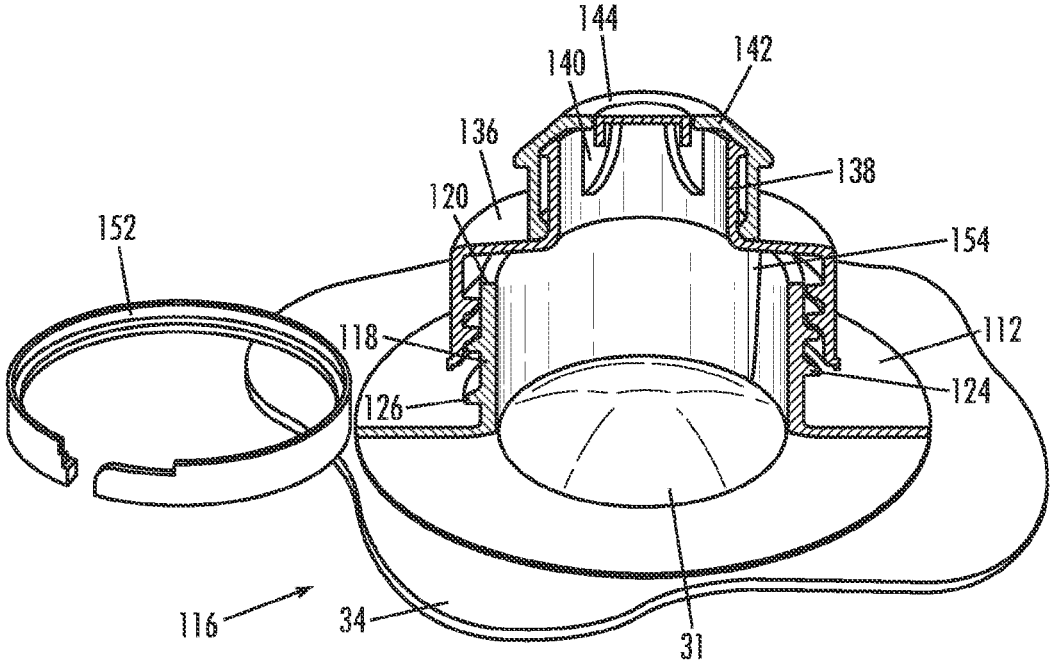
FIG. 12 is a perspective cut-away view of a container top in accordance with one embodiment of the present invention.
Figure 13:
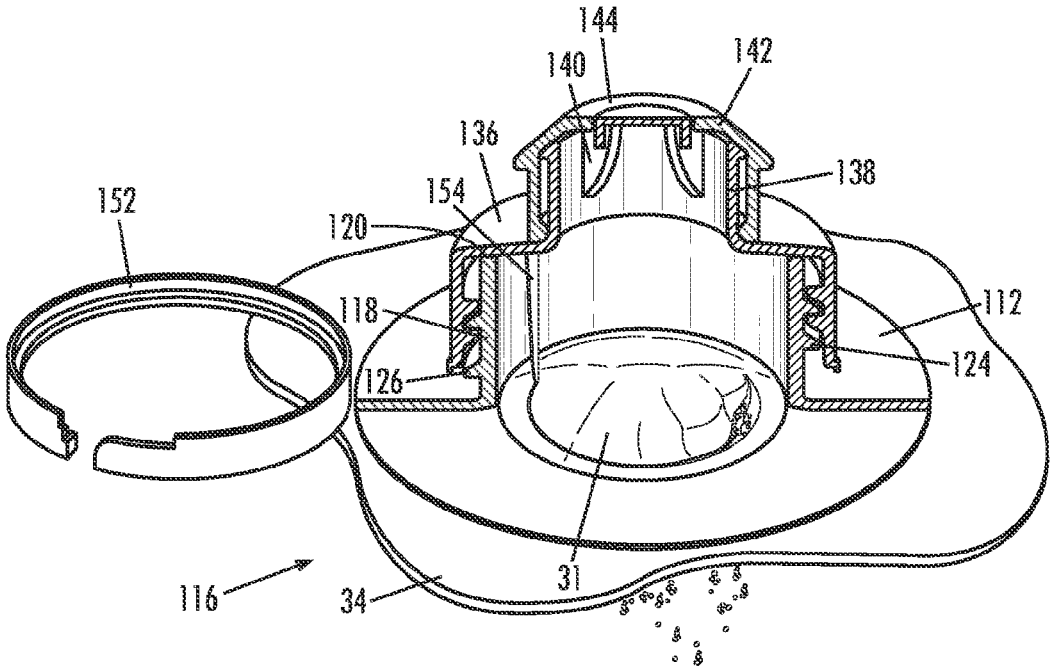
FIG. 13 is a perspective cut-away view of a container top in accordance with one embodiment of the present invention.
Figure 14:
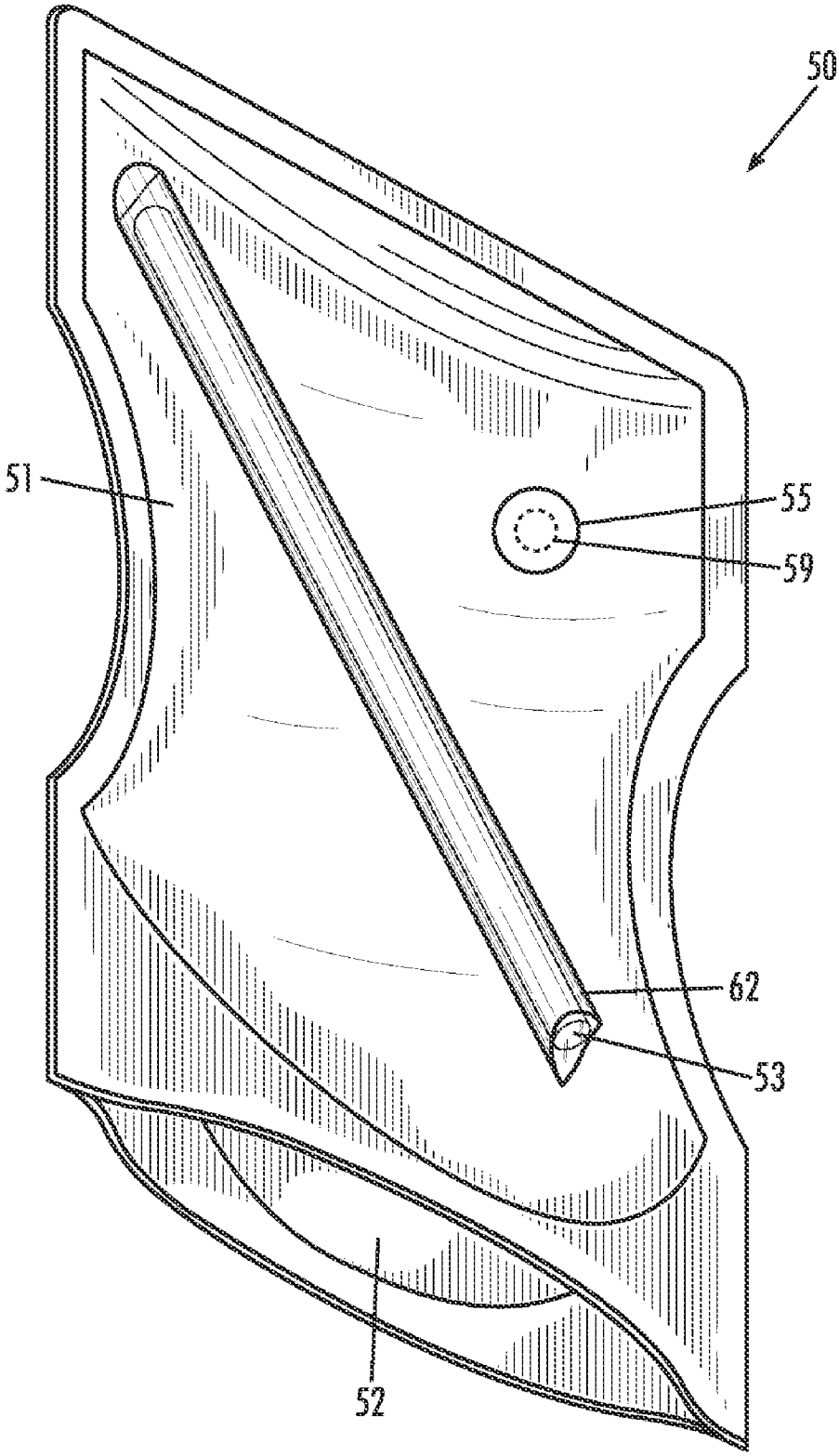
FIG. 14 is a perspective view of a container in accordance with an embodiment of the present invention.
Figure 15:
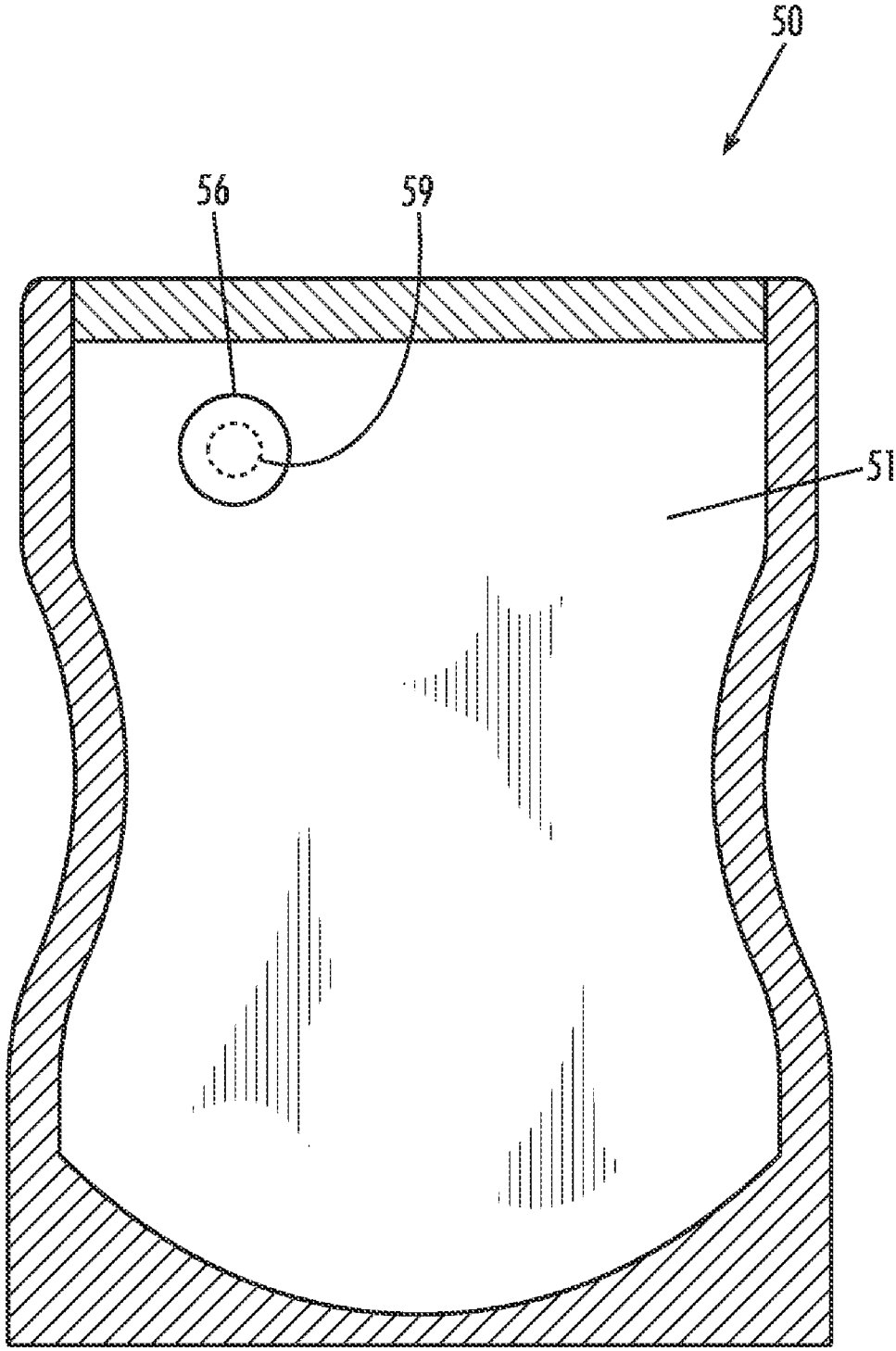
FIG. 15 is a cut-away view of the interior of the container illustrated in FIG. 14.
Figure 16:
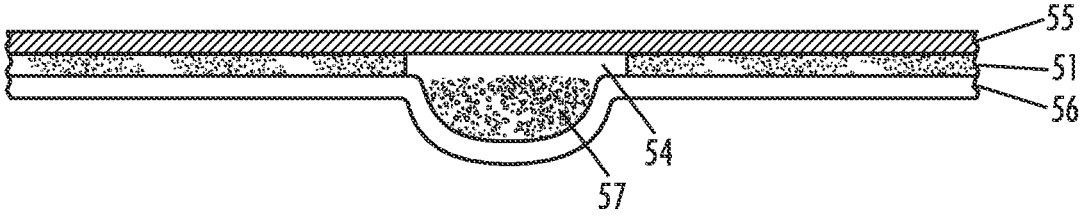
FIG. 16 is a partial cut-away view of a container in accordance with a particular embodiment of the container.
Figure 17:
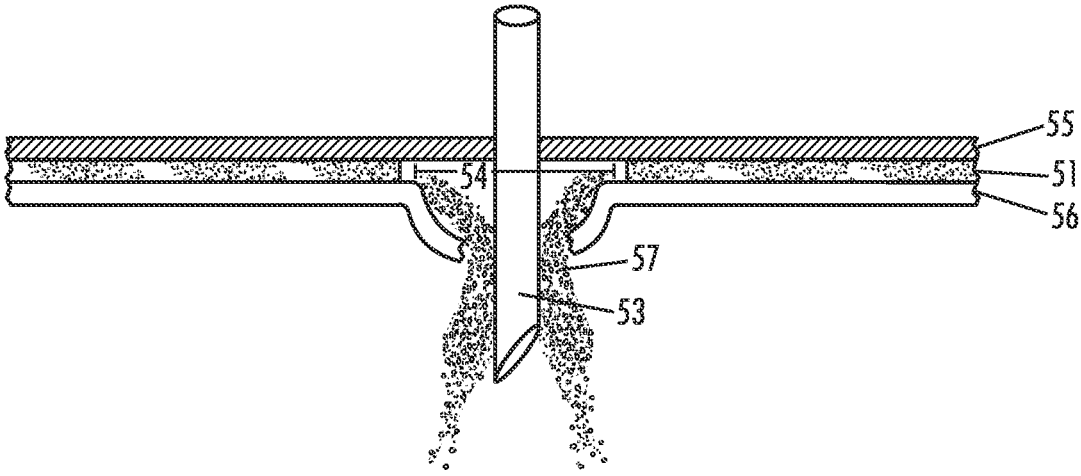
FIG. 17 is a partial cut-away view of a container in which a straw is inserted into the container.

Referring particularly to FIGS. 12-13, cylindrical top portion 112 may include a threaded cylindrical portion 118 that defines a rim 120 at one end thereof. Rim 120 may define an aperture in fluid communication with an inner chamber defined by cylindrical top portion 112. Cylindrical top portion 118 may be adapted for the removable receipt of closure 116 by a helical thread 124, which may be integrally formed on threaded cylindrical portion 118. Helical thread 124 may begin proximate to rim 120 and may terminate proximate a flange 126.

In some embodiments, closure 116 includes an annular cap having a helical thread 130 on its inner circumference for removably securing annular cap to the externally threaded cylindrical top portion 118. The outer circumference of the annular cap may contain ribs or knurling to allow the user to more easily grip closure 116 to remove it from, or fit it on, top portion 112. In addition to its internally threaded cylindrical wall, the annular cap may include an annular end wall 136 having an extension 138 defining a though hole 140 therein. A second annular enclosure 142, having an opening 144 therein, may be operatively secured to annular end wall extension 138 so that second annular enclosure 142 is moveable between a first position where second closure 142 prevents the contents of the container from flowing through opening 140, and a second position where the contents of the container are able to flow through opening 140. A cutting portion, or blade 154, may extend axially downward from the under surface of annular end wall 136 proximate rim 120. It should be understood that closure 116 may be formed from any type of suitable closure known in the art.

A blister pack 31 may be may be bonded to the top wall 34 of container 30. A tear band 152 may retain closure 116 on cylindrical top portion 112 in a raised position so that blade 154 does not engage blister pack 31. That is, when tear band 152 is in place, the tear band blocks further tightening of closure 116 so that blade 154 cannot engage blister pack 31. The tear band also acts as an anti-tamper band to prevent the closure from being removed prior to purchase by a consumer. The tear band may be connected to the bottom edge of annular cap 128 in many ways. For example, tear band 152 may be integrally formed with annular cap 128 with a gap formed therein to allow a consumer to tear the band away from the cap. In other embodiments, tear band 152 may connect to a lower edge of annular cap 128 by a plurality of relatively thin and frangible breakaway tongues or webs (not shown). An internally, radially inwardly projecting and angularly extending ridge(s) (not shown) may be formed on an inner circumference of tear band 152, which engages an under surface flange 126. Thus, tensile forces rotationally fix the tear band to the flange as annular closure 116 is unthreaded off the container. As the annular closure is rotationally removed, both tensile and torsional forces acting on the webs cause the webs to sever allowing closure 116 to be completely removed. If closure 116 is removed, blister pack 31 remains bonded to container 30, thereby protecting the contents of the container and the nutritive substance from exposure to the atmosphere and each other.

Referring to FIGS. 12-13, in use, a consumer may remove tear band 152 (FIG. 12) and rotate closure 116 clockwise (with respect to FIG. 12). As closure 116 turns, blade 154 is drawn downward into contact with blister pack 31, which causes blade 154 to cut the blister pack 31. Continued rotation (FIG. 13) of closure 116 in the clockwise direction causes blade 154 to cut an arc 156 through the blister pack adjacent to rim 120, thereby exposing the nutritive substance 38 to the atmosphere and the contents of the container. When tear band 152 is attached, blade 154 may be positioned adjacent to blister pack 31 so that a minimum number of revolutions are necessary to cut blister pack 31. In this configuration, when closure 116 is in its rotated position, each time the consumer inverts the container, the contents of the container flow from the container through aperture 122 into contact with the nutritive substance 38, which provides a gradual release of the nutritive substance 38 during consumption of the product.

It should be understood that a tear band is not required in this embodiment. Any device which prevents blade 154 from contacting blister pack 31 until just before consumption of the product may be utilized in this embodiment.

In a separate embodiment, the container closure may have a cutting edge on the outside of the cap. The cap can be removed from the container closure, used to pierce or cut the blister pack, and then replaced upon the container to intermix the contents of the container with the nutritive substance.

In a particular embodiment, the blister pack may be glued to the inner sealing layer of the container. A hole may be pre-cut into the paperboard container and the blister pack may be glued to the inner sealing layer of the container over the hole. This allows the blister pack to be added in a secondary operation. A straw may be used in combination with the blister pack of this embodiment or any of the embodiments described herein. The straw may perforate the blister pack and inner sealing layers of this embodiment. In this embodiment, the blister pack is arranged such that the top of the blister pack does not extend past the top of the paper portion of the container. This allows the container to accept normal case stacking, palletizing, and shipping without puncturing or otherwise damaging the blister pack.

In yet another embodiment, the blister pack is designed such that it can be punctured by pushing with one's finger. In this embodiment, the blister pack is scored and is easily punctured upon manual pressure. The blister pack may tear upon finger pressure, exposing the nutritive substance to the container.

In some embodiments, the blister pack of the present invention may be manufactured in a strip pack or a chain pack format.

In another embodiment, the container is a flexible pouch made of plastic film. In an embodiment, the plastic film may be a laminate foil. In other embodiments, the plastic film may comprise polyethylene, polypropylene, or any other plastic film known in the art. In some embodiments, the container is generally triangular in cross-section and has a flat or gusseted base which supports the pouch in a stand-up position.

FIGS. 14-19 illustrate an embodiment of such a container. In this embodiment, the flexible container 50 has at least one sidewall 51 and a base 52. In an embodiment, the container 50 has two opposite sidewalls that are bonded at the side and top edges, each sidewall being bonded to the base 52 at the bottom edge.

In an embodiment, one sidewall 51 of the container 50 has an aperture 59 formed therein. The aperture 59 may be circular or may be any shape known in the art. In an embodiment, the aperture 59 is located near the top of sidewall 51.

An outer pierceable seal 55 may be permanently bonded to the outside of the sidewall 51, covering aperture 59. In addition, an inner pierceable seal 56 may be permanently bonded to the inside of sidewall 51, covering aperture 59. In a particular embodiment, outer pierceable seal 55 and inner pierceable seal 56 form a pocket 54 between them, located within aperture 59.

In some embodiments, the outer pierceable seal 55 is dimpled, or otherwise marked, such that a consumer can easily identify the outer pierceable seal 55 and the aperture 59 beneath it. In other embodiments, the outer pierceable seal 55 may be colored or textured such that it is easily identifiable against sidewall 51. The outer pierceable seal 55 may be circular, square, triangular, star-shaped, or any other shape known in the art. The outer pierceable seal 55 and inner pierceable seal 56 may be made from a plastic material or a foil material. In an embodiment, the outer pierceable seal 55 and inner pierceable seal 56 may be thin films of aluminum.

A nutritive substance 57 may be present in pocket 54. In this configuration, the nutritive substance 57 is protected from the container contents and the atmosphere until the outer pierceable seal 55 is pierced.

A straw 53 may be provided in connection with the container 50. The straw may be removably attached to the sidewall 51 of the container 50. The straw may be deformable. In some embodiments, the straw is enclosed in a plastic sheath 62, preventing contact between the straw 53 and the atmosphere until the plastic sheath 62 is removed. In particular embodiments, the protective sheath 62 containing the straw 53 is removably bonded to the outside of the container 50. In order to facilitate the piercing of the outer pierceable seal 55 and inner pierceable seal 56, the straw 53 may have a sharpened end. The straw 53 may have a stopper, preventing insertion of the entire straw 53 into the container.

In consumption of the product contained within container 50, the straw 53 is inserted through outer pierceable seal 55 and inner pierceable seal 56 in a cross-directional angle, contacting the contents of the container. As the straw pierces outer pierceable seal 55 and inner pierceable seal 56, pocket 54 is pierced and the nutritive substance 57 is dispersed from pocket 54 into the interior of container 50. The nutritive substance 57 then immediately contacts and mixes with the contents of container 50. The product may then be consumed by drinking through the straw.

In a particular embodiment, the hole that is pierced in outer pierceable seal 55 is the same circumference as the outer surface of the straw 53, such that the nutritive substance 57 is not expelled into the atmosphere via the hole in outer pierceable seal 55.

Figure 18:
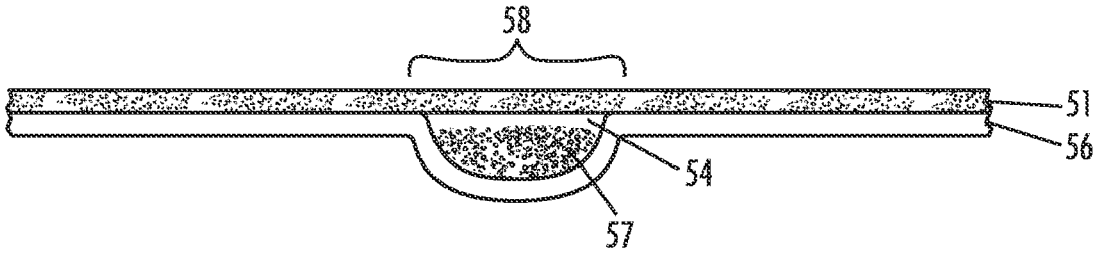
FIG. 18 is a partial cut-away view of another embodiment of the container.
Figure 19:
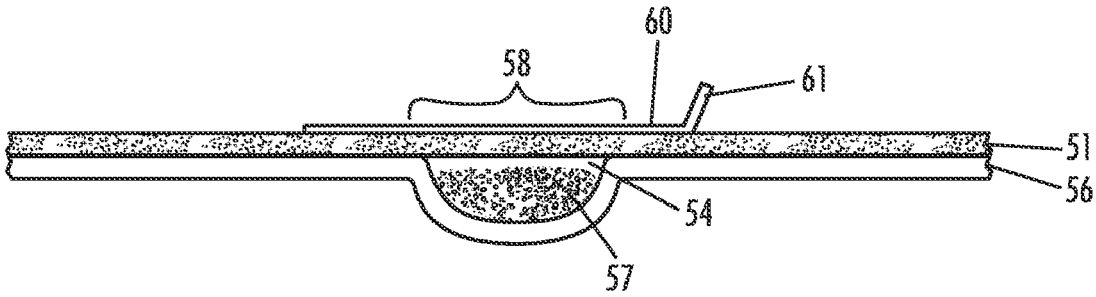
FIG. 19 is a partial cut-away view of yet another embodiment of the container.

In a separate embodiment, illustrated in FIGS. 18-19, sidewall 51 does not have an aperture formed therein. Instead, sidewall 51 has a weakened region 58 which is adapted to be pierceable by a straw via insertion therethrough. The weakened region 58 may be located near the top edge of sidewall 51. The weakened region 58 may be formed by creating a dimple in the sidewall 51 under heat and pressure. The weakened region 58 may have a thickness that is thinner than the remainder of sidewall 51. In this embodiment, locating indicia may be printed on the sidewall 51 surrounding the weakened region 58 to identify its location.

An inner pierceable seal 56 may be permanently bonded to the inside of sidewall 51, surrounding the weakened region 58. In a particular embodiment, the sidewall 51 and inner pierceable seal 56 form a pocket 54 between them. As a straw pierces sidewall 51 and inner pierceable seal 56, pocket 54 is pierced and the nutritive substance 57 is dispersed from pocket 54 into the interior of container 50. The nutritive substance 57 then immediately contacts and mixes with the contents of container 50. The product may then be consumed by drinking through the straw.

In this embodiment, a protective cover 60 may be removably adhered to the outside of sidewall 51, over the weakened region 58, to prevent inadvertent puncture during transportation and storage. The protective cover may include a tab 61 to enable a user to pull upwards and/or backwards to remove the protective cover 60. The tab 61 may be located along an edge of protective cover 60 or may be attached across the center of protective cover 60. Tab 61 may be formed from the same material as protective cover 60 or may be formed of, or coated with, a different material to increase gripability of the tab. The tab 61 may be bonded to or integrally formed with protective cover 60.

In an embodiment, the container of the invention has sufficient barrier properties to prevent passage of essential oils, vitamins, minerals, or flavorings into or out of the container itself. In some embodiments, the paper or cardboard container of the invention could be laminated on one or both sides with one or more layers of polyethylene, acrylonitrile-butadiene-styrene, styrene-acrylonitrile, polyvinyl chloride, polystyrene, polycarbonate, polypropylene, polyethylene terephthalate, glycol-modified polyethylene terephthalate, nylon, polyvinylidene chloride, or ethylene-vinylalcohol copolymer. In this embodiment, a polymeric adhesive may be used to bond the layers. In other embodiments, the paper or cardboard may be laminated with a dual-layer laminate foil. In this embodiment, the foil layer may comprise aluminum foil.

The container of the invention may be formed using conventionally-known manufacturing techniques, such as a horizontal form-fill-seal machine with single or multiple lanes, a flat bed pre-made pouch machine, or a vertical form-fill-seal machine. The container is generally formed by folding sheets of material over each other achieve a predetermined shape. The aperture may be punched in one wall of the container or the weakened region may be formed for insertion of the straw. Any necessary seals may be adhered to the container wall. The edges may be joined together using a sealing technique such as bonding or welding. An upper or lower edge of the front and back panel may not be sealed until after the container is filled. The container may be placed in a gripper assembly or a holder such as a cup or puck prior to the filling process. To fill the container, the upper edges of the container are spread apart. Grippers may be utilized to pull the panels apart. In addition, a concentrated flow of gas may be directed toward the upper edge of the container to separate the panels or a suction cup may be used to separate the panels. The container is then filled, sterilized, sealed, and finished.

In each of the above described embodiments, the nutritive substance may be any known in the art. For example, the nutritive substance may be a macronutrient, a micronutrient, a bioactive agent, a long-chain polyunsaturated fatty acid, a probiotic, a prebiotic, a vitamin, a mineral, or combinations thereof. The nutritive substance may be a substance that is sensitive to heat, light, oxygen, moisture, or any component that is contained within the container body. In an embodiment, the nutritive substance is maintained as sterile until the user desires to mix the nutritive substance and the product within the container.

In a particular embodiment, the nutritive substance is a probiotic. The probiotic may be any probiotic known in the art. In particular embodiments, the probiotic is impregnated into a gum substrate. The gum substrate may, in some embodiments, comprise plant starches, instant hydratable starches, pregelatinized starches, instantized cold soluble starches, disintegratable starches, immobilized food-grade resins, or low-melting fats impregnated with disintegrating starches. In a particular embodiment, the gum substrate may comprise a low-melting fat impregnated with a disintegrating starch, which on contact with water can swell and release the probiotic. In another embodiment, the gum substrate may comprise an immobilized food-grade resin, which can be used to adsorb the probiotic. Upon contact with water, the immobilized food grade resin readily dislodges the probiotic. In particular embodiments, hydrophilic substances, such as emulsifiers, can be included in the gum substrate to assist in the release of the probiotic upon contact of the probiotic with the product.

In another embodiment, the probiotic may be applied as a powder that is suspended in an oil- or wax-based suspension. Any oil or wax known in the art may be utilized in this embodiment, assuming it does not adversely affect the properties of the container or the contents of the container. In yet another embodiment, the probiotic is applied as a powder.

In at least one embodiment, the probiotic may be *Lactobacillus rhamnosus* GG. In another embodiment, the probiotic may be *Bifidobacterium* BB-12. In a particular embodiment, the probiotic may be a combination of *Lactobacillus rhamnosus* GG and *Bifidobacterium* BB-12. In some embodiments, the level of probiotic present is within the range of about $1\times10^5$ colony forming units (cfu) per gram formula to about $1\times10^{10}$ cfu per gram formula. In other embodiments, the level of probiotic present is within the range of about $1\times10^6$ colony forming units (cfu) per gram formula to about $1\times10^9$ cfu per gram formula. In some embodiments, the level of probiotic present is within the range of about $1\times10^6$ colony forming units (cfu) per gram formula to about $1\times10^8$ cfu per gram formula.

Because many probiotics are sensitive to heat and may be damaged or killed if subjected to the heat treatment that is necessary for many food and drink products, the present invention provides the compartmentalized storage of a probiotic. In the present invention, the product contained within the container may undergo heat treatment or sterilization during the packaging process. After the product has been packaged into a container and sterilized, a seal containing a probiotic layer may be affixed to the container. The package may then be prepared for shipment or display. In these configurations, the probiotic is not subjected to damaging heat treatment during packaging and is kept separate from the product itself until consumption, at which time the two can be intermixed.

Thus, in some embodiments, the invention comprises a method for making a delivery container comprising a) providing a container as described herein; b) filling the container with a product; c) sterilizing the product-filled container; and d) sealing the container with a seal as described herein.

The product contained within the container may be any product known in the art. In some embodiments, the product is in a form selected from a liquid, ready-to-use product, liquid concentrate, fluid, powder, suspension, emulsion, or combination thereof. In some embodiments, the product contained within the container is a food or drink product. In a particular embodiment, the product contained within the container is a nutritional supplement for children or adults. In another embodiment, the product contained within the container of the invention may be a beverage, such as milk, fruit juices, or similar products. In some embodiments, the product may be an infant formula.

All references cited in this specification, including without limitation, all papers, publications, patents, patent applications, presentations, texts, reports, manuscripts, brochures, books, internet postings, journal articles, and/or periodicals are hereby incorporated by reference into this specification in their entireties. The discussion of the references herein is intended merely to summarize the assertions made by their authors and no admission is made that any reference constitutes prior art. Applicants reserve the right to challenge the accuracy and pertinence of the cited references.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the preferred versions contained therein.

What is claimed is:

1. A container for delivering a nutritive substance comprising:

a. a container body having a base, at least one sidewall, and a top wall, wherein an aperture is formed in the top wall;

b. an outer releasable seal releasably bonded to the exterior of the top wall, surrounding the aperture;

c. an inner sealing layer permanently bonded to the interior of the top wall, surrounding the aperture, wherein the inner sealing layer and the outer releasable seal are permanently bonded to one another within the aperture; and d. a nutritive substance disposed between the inner sealing layer and the outer releasable seal such that removal of the outer releasable seal and inner sealing layer exposes the nutritive substance to the contents of the container.

2. The container of claim 1, wherein a pull-tab is present on the outer releasable seal.

3. The container of claim 1, wherein the inner sealing layer is an unbroken interior layer of the packaging.

4. The container of claim 1, wherein the outer releasable seal comprises a laminate foil.

5. The container of claim 1, wherein the inner sealing layer comprises a laminate foil.

6. The container of claim 1, wherein the nutritive substance is disposed along the circumference of the aperture.

7. The container of claim 1, wherein the nutritive substance is bonded to the upper side of the inner sealing layer.

8. The container of claim 1, wherein the nutritive substance is a probiotic.

9. The container of claim 1, wherein when the outer releasable seal is separated from the container, the bond between the outer releasable seal and the inner sealing layer is maintained and the portion of the inner sealing layer located within the aperture is removed from the container.

* * * * *